US010685531B2

(12) United States Patent
Winchell

(10) Patent No.: US 10,685,531 B2
(45) Date of Patent: Jun. 16, 2020

(54) ELECTRONIC GAMING MACHINE CONVERSION SYSTEM AND RELATED METHODS

(71) Applicant: Eclipse Route Operations LLC, Las Vegas, NV (US)

(72) Inventor: Ron Winchell, Las Vegas, NV (US)

(73) Assignee: ECLIPSE ROUTE OPERATIONS LLC, Las Vegas, NV (US)

( * ) Notice: Subject to any disclaimer, the term of this patent is extended or adjusted under 35 U.S.C. 154(b) by 0 days.

(21) Appl. No.: 16/367,580

(22) Filed: Mar. 28, 2019

(65) Prior Publication Data

US 2019/0304247 A1 Oct. 3, 2019

Related U.S. Application Data

(60) Provisional application No. 62/649,784, filed on Mar. 29, 2018.

(51) Int. Cl.
*G07F 17/32* (2006.01)

(52) U.S. Cl.
CPC ..... *G07F 17/3218* (2013.01); *G07F 17/3223* (2013.01)

(58) Field of Classification Search
CPC ..... G07F 17/32
See application file for complete search history.

(56) References Cited

U.S. PATENT DOCUMENTS 5,655,966 A * 8/1997 Werdin, Jr. ..... A63F 3/081 273/309
2011/0201431 A1* 8/2011 Meyer ..... G07F 17/32 463/46

* cited by examiner

*Primary Examiner* — Omkar A Deodhar
(74) *Attorney, Agent, or Firm* — Howard M. Gitten; Lewis Brisbois Bisgaard & Smith LLP

(57) ABSTRACT

A bracket system and related methodology for converting a slant-top electronic gaming machine to a bar-top or table-top electronic gaming machine. The slant-top machine is broken down to its primary cabinet. The bracket system is attached to the cabinet and the unit is inserted into a bar-top base. Flanges on the bracket secure the cabinet to the base. At least a portion of the cabinet is concealed inside the base.

7 Claims, 2 Drawing Sheets

ELECTRONIC GAMING MACHINE CONVERSION SYSTEM AND RELATED METHODS

CROSS REFERENCE TO RELATED APPLICATIONS

This application claims the benefit of U.S. Provisional application No. 62/649,784 filed Mar. 29, 2018.

BACKGROUND OF THE INVENTION

This invention is related a system and related methodology for converting an electronic gaming machine (EGM) of one format, for example a "slant-top" design, to another format, for example a "bar top" design.

Traditional "slant-top" EGMs comprise an integrated, self-contained machine generally comprising a large cabinet or console retaining a primary display, a mid-section housing an array of buttons or actuators for user interaction and a credit-input mechanism such as a bill collector, car reader, or coin chute, and a lower credit output receptacle such as a coin tray. In some embodiments, the credit output receptacle is obviated by a ticket printer. Some slant-top units also include a secondary display or "topper," disposed above the primary display that is used to display artwork or secondary interactions. The cabinet houses the various electronic components of the machine, including computer components such as a microcontroller or central processing unit, various inputs and outputs, random access memory, hard drives, and communication devices such as modems or network adapters. The top of the console typically includes a tower light to signal a win or other event. Typically the mid-section region is table-height so that a user can comfortably sit in front of the unit for gaming, with the primary display oriented substantially vertically (or at a slight angle) for face-on viewing of the sitting or standing user. Slant-top EGMs have recently taken advantage of large, wide format displays such as LED or LCD flat panels for optimal resolution, viewing angle, and brightness. One or more self-contained slant-top units can be aligned in a row or bank or, alternatively, they can be configured as a standalone "independent" gaming machines.

In contrast, a "bar top" or "table top" EGM is a gaming unit configured to be installed within an enclosed or semi-enclosed bar or table. These units comprise a surface mount primary plate or bezel that houses a display, an array of buttons or actuators for user interaction, the credit-input mechanism such as a bill collector, car reader, or coin chute, and credit output device such as a ticket printer. Below the surface mount plate are the various electronic components of the machine, including computer components such as a microcontroller or central processing unit, various inputs and outputs, random access memory, hard drives, and communication devices such as modems or network adapters. The bar top unit is installed into a cavity of a bar or table such that surface mount plate is retained against the supporting surface of the bar or table with the electronic components hidden and inaccessible inside the cavity thereof. Typically these bar or table top units are configured such that the primary display is substantially horizontal or otherwise aligned with the surface of the bar or table, or perhaps slightly angled upward such that the user sitting at the bar or table can view the display by looking at a somewhat downward angle. Traditionally, given the relative size and space constraints, the displays associated with bar-top units are inferior in size and picture quality to those used in slant-top designs.

Recent regulations in particular jurisdictions have required significant changes to the manner and means by which users interact with EGMs. In some jurisdictions, slant-top EGMs are no longer permitted in non-casino settings such as bars, clubs, and lounges. Regulations have limited EGMs in such establishment to the bar-top or table-top configurations. While customers of these establishments may actually prefer the bar-top design, many owners and operators have invested substantial financial resources in slant-top EGMs that they can no longer use. Accordingly, there is a need in the art for a system and method to convert slant-top EGMs to a bar-top or table-top configuration in order to meet regulations without needing to entirely replace existing EGMs.

BRIEF DESCRIPTION OF THE DRAWINGS

The drawings appended hereto are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION

Figure 1D:
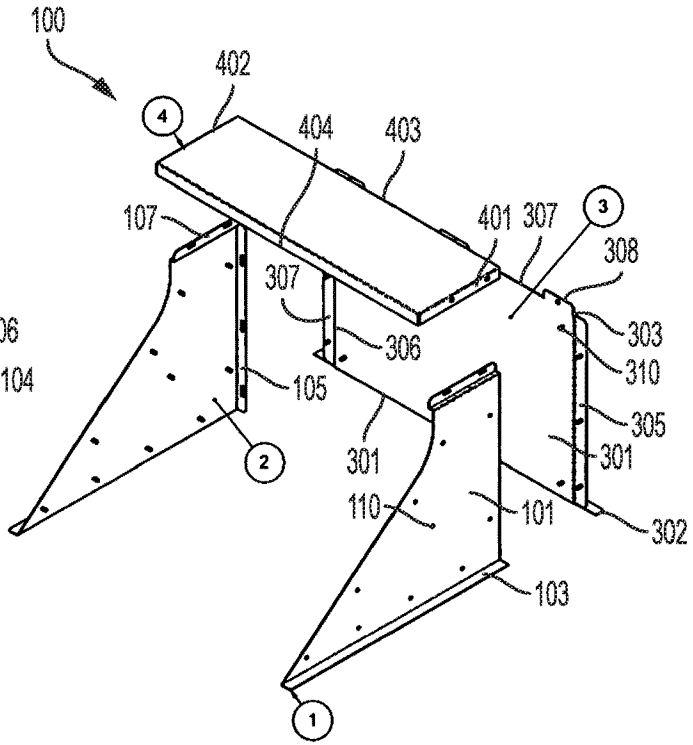
FIG. 1*d* is an exploded view of the conversion bracket system constructed in accordance with the invention.
Figure 1E:
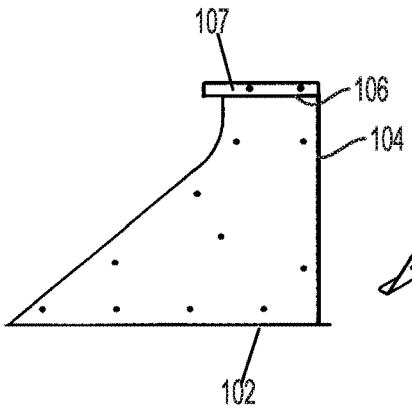
FIG. 1*e* is an elevation view of a side element constructed in accordance with the invention.
Figure 1B:
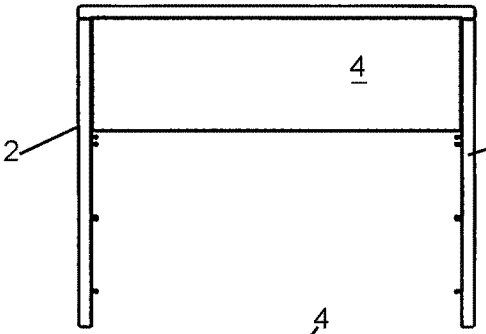
FIG. 1*b* is a schematic rear elevation view of the conversion bracket system constructed in accordance with the invention.
Figure 1C:
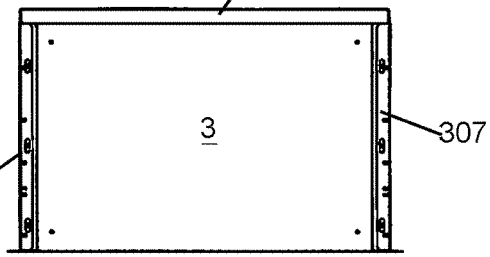
FIG. 1*c* is a schematic top plan view of the conversion bracket system constructed in accordance with the invention.
Figure 1A:
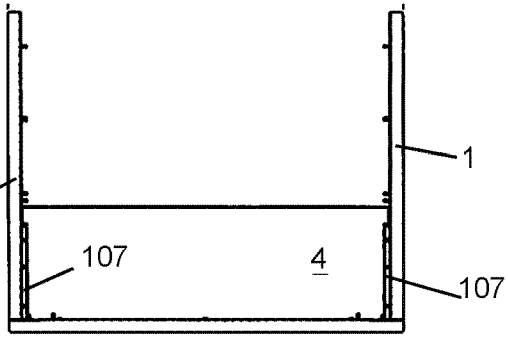
FIG. 1*a* is a schematic bottom plan view of one embodiment of the conversion bracket system constructed in accordance with the invention.

For the purposes of promoting an understanding of the principles of this disclosure, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc. The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional un-recited elements or method steps. As used herein the term "distal" generally is understood to mean that which is situated away from the center of the identified structure or from the point of attachment of said structure. The term "proximal" generally is understood to mean that which is situated nearer to the center of the body or to the point of attachment.

With reference to FIG. 1, shown is one embodiment of a conversion bracket system 100 comprising a right side element 1, a left side element 2, a back element 3, and a top element 4. The right and left side elements 1 and 2 have substantially the same shape but are in opposing configuration. The shape and size of the right and left side elements 1 and 2 is configured to follow the contour of the cabinet on which it is installed. In some embodiments, the shape is substantially triangular or an "offset" trapezoid having a wide base dimension and a somewhat narrower top dimension. One or more through-holes 110 are provided through the surface 101 of each of the right and left side elements 1 and 2, which through-holes receive fasteners to attach and secure the side elements to the target cabinet. The bottom edges 102 of each of the right and left side elements 1 and 2 includes an outwardly extending lip 103 used to support the cabinet and help secure the cabinet to the bar or table surface as further described herein. In some embodiments, the lip 103 is oriented 90 degrees to the surface of the elements. In some embodiments, the rear edge 104 of each of the right and left side elements 1 and 2 includes a mounting flange 105 through which fasteners are received in order mate with the back element 3. Similarly, the top edge 106 of each of the right and left side elements 1 and 2 includes a mounting flange 107 through which fasteners are received in order mate with the top element 4.

In some embodiments, the back element 3 is shown as substantially rectangular in shape but other configurations are contemplated depending on the contours of the target cabinet. The back element 3 is configured to be secured to the target cabinet by way of one or more through-holes 310 through the surface 301 thereof. In some embodiments, the bottom edge 301 of back element 3 includes an outwardly extending lip 302 used to support the cabinet and help secure the cabinet to the bar or table surface, in conjunction with the lips 102 of the right and left side elements 1 and 2. The lip 302 is, in some embodiments, oriented 90 degrees to the surface 301 of the back element. In some embodiments, the side edges 303 and 304 include respective mounting flanges 305 and 306 that mate with the flanges 105 on the rear edges 104 of the right and left side elements 1 and 2. The top edge 307 of the back element 3 may also include one or more mounting flanges 308 which mate with the top element 4.

The top element 4, in some embodiments, is shown as substantially rectangular but is otherwise configured to match the shape and dimension of the other components of the bracket system 100. The top element 4 is configured to engage and fasten to the side elements 1 and 2 at its lateral side edges 401 and 402. The rear edge 403 is configured to engage and fasten to back element 3. In some embodiments, the top element 4 has a finished front edge 404.

Figure 2:
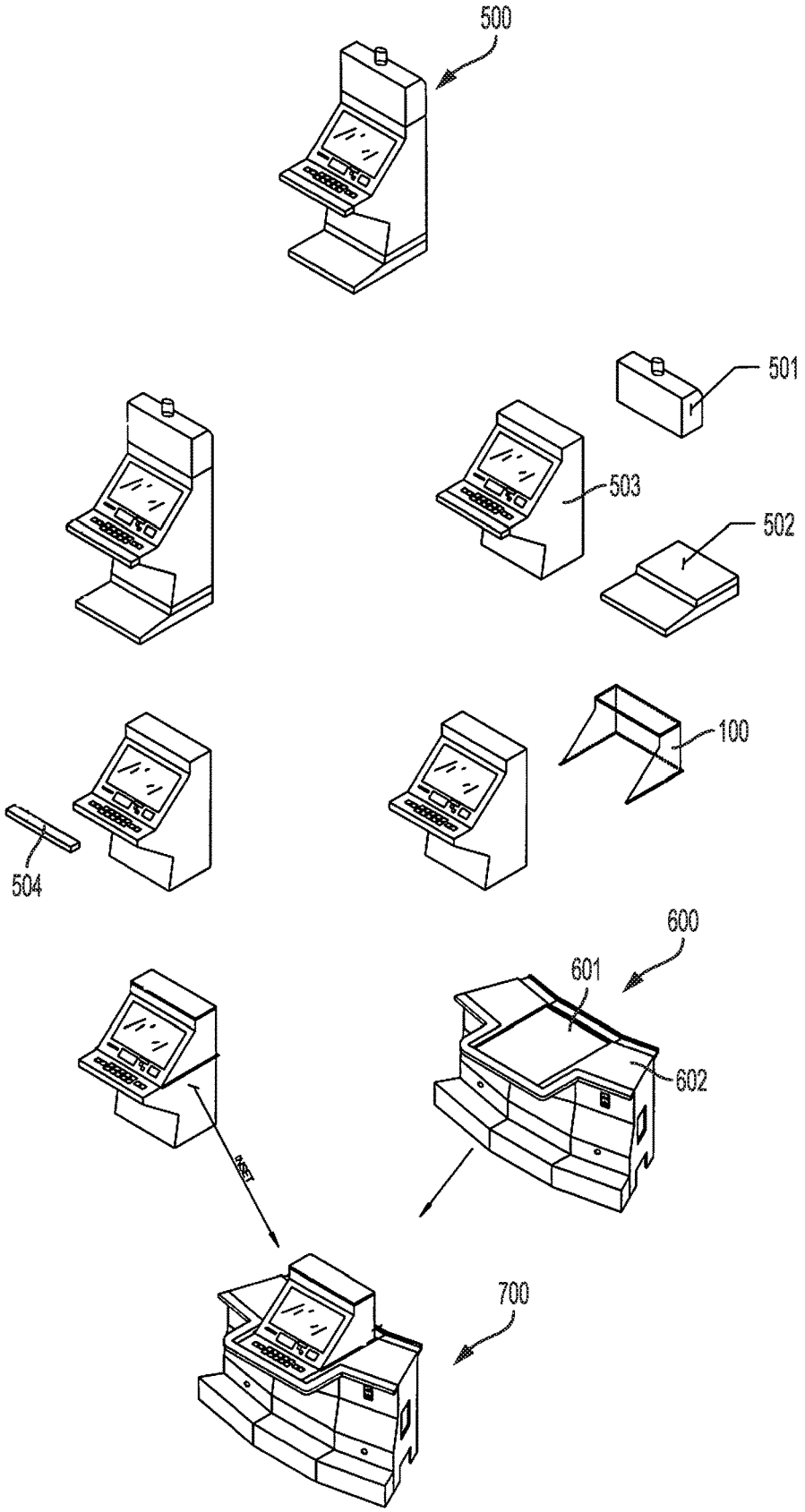
FIG. 2 is an operational view of steps of one embodiment of the method for converting a slant-top EGM to a bar-top or table-top EGM.

With reference to FIG. 2, shown is a schematic of the process of converting a slant-top machine to a bar-top machine using the system 100. The slant-top machine 500 comprises a central cabinet 503, a topper 501, and a footrest 502. In some embodiments, the slant-top machine 500 includes a hand rest 504. The slant-top machine is converted as follows. First, the cabinet 503 is separated from its secondary components. In some embodiments, this is accomplished by removing the topper 501, footrest 502, and hand rest 504 from the cabinet 503 although these components are merely exemplary secondary features of the machine 500. To that end, it is appreciated that the remaining cabinet 503 comprises a display, button array, credit slots, and credit output devices with the constituent internal electronic and computing components and surrounding encasement.

Next, the bracket system 100 is attached to the cabinet 503. The right and left side elements 1 and 2 are secured to the respective sides of the cabinet, the back element 3 is secured to the rear of the cabinet 503 and the top element 4 is secured to the top of the cabinet 503 as indicated. The elements 1, 2, 3, and 4 of the system 100 are secured to one other by fasteners so that the system 100 retains and is secured to the cabinet 503.

Next, the cabinet 503 is secured to the base 600, which base may be configured as a bar-top, table-top or like structure. In some embodiments, the base 600 includes a cavity 601 and a top surface 602. The cabinet 503 is brought into alignment with the cavity 601 and is dropped or inserted therein such that the upper part of the cabinet, from the bottom of the system 100 upward, extends above the surface 602 with the remaining bottom part of the cabinet disposed inside the base 600. The flanges 103 and 302 of the respective side elements 1 and 2 and the back element 3 are disposed against the top surface 602 and, in some embodiments are fastened thereto. A trim piece or valance can be disposed over the flanges in order to conceal the hardware and provide a finished look. The resultant converted bar-top machine 700 is shown in FIG. 2.

It is appreciated and understood that the bracket system 100 and its components may comprise materials of varying material and cross-section. For example, wood, steel, aluminum, and combinations thereof may be employed. The means and manner by which the brackets are secured to the cabinet is not limiting although in some embodiments screws, bolts, rivets or like fasteners can be used. Other hardware, such as a nuts, washer, and adhesives may be utilized to reinforce the attachment points.

By way of non-limiting example, it is helpful to describe certain relative dimensions of system components. In some embodiments, the right and left side elements 1 and 2 are 17.75" H×23" D with a contour following that of the given cabinet. In some embodiments, the back element 3 is 27.75" W×17.75" H. In some embodiments the top element 4 is 27.75" W×9" D×1.5" H. Notwithstanding the foregoing, the dimensions of the various components can vary depending on the size, shape, orientation, attachment points, and other geometry of the target cabinet.

It is appreciated and understood that the present disclosure references a conversion of a "slant-top" unit to a "bar-top" unit but these terms are not limiting and such use is merely exemplary. As will be apparent, the present system 100 is configured to facilitate the conversion of any configuration gaming machine to any other desired configuration, depending on the configuration of the base 600. It is apparent, however that the slant-top to bar-top conversion facilitates a lowering in height of the critical display and button array components of the machine so that the unit is more accessible in a table height situation. Additionally, it is apparent that the converted machine 700 has the benefit of an improved viewing angle as compared to traditional bar-top designs that have a "flatter" oriented display than that typically found on slant-tops.

While specific embodiments have been described in detail, those with ordinary skill in the art will appreciate that various modifications and alternatives to those details could be developed in light of the overall teachings of the disclosures. Accordingly, the particular arrangements disclosed are meant to be illustrative only and not limiting of the invention, which is to be given the full breadth of the appended claims, and any and all equivalents thereof.

What is claimed is:

1. A bracket system for converting a slant-top electronic gaming machine to a bar-top gaming machine, comprising:

a right side element, a left side element, a back element, and a top element;

wherein the back element is attached to a respective rear edge of each of the right side and the left side elements;

wherein the top element is attached to a respective top edge of each of the right side and the left side elements;

wherein bottom edges of each of the right side element, left side element, and back element include an outwardly extending flange;

wherein the bracket system is attached to a cabinet of the slant-top electronic gaming machine; and wherein the cabinet is received in a base and the flanges are secured to a surface of the base to form said bar-top gaming machine.

2. The bracket system of claim 1, wherein the right side and left side elements contour to a shape and configuration of the cabinet.

3. The bracket system of claim 1, wherein the base includes a cavity in which at least a portion of the cabinet is disposed.

4. A method for converting a slant-top electronic gaming machine to a bar-top gaming machine, comprising:

providing a bracket system comprising a right side element, a left side element, a back element, and a top element; wherein the back element is attached to a respective rear edge of each of the right side and the left side elements; wherein the top element is attached to a respective top edge of each of the right side and the left side elements; wherein bottom edges of each of the right side element, left side element, and back element include an outwardly extending flange;

attaching the bracket system to the cabinet of the slant-top electronic gaming machine;

inserting the cabinet into a base;

securing the flanges of the bracket system to a surface of the base to form said bar-top gaming machine.

5. The method of claim 4, wherein the right side and left side elements contour to a shape and configuration of the cabinet.

6. The method of claim 5, wherein the base includes a cavity in which at least a portion of the cabinet is disposed.

7. The method of claim 4, comprising the step of attaching a valance to the surface of the base, the valance disposed over the flanges.

* * * * *